United States Patent [19]

Hansson

[11] Patent Number: 4,674,682

[45] Date of Patent: Jun. 23, 1987

[54] METHOD OF MIXING AN ATOMIZED LIQUID INTO A GAS FLOW AND A DEVICE FOR CARRYING OUT SAID METHOD

[75] Inventor: Bengt L. Hansson, Löddeköpinge, Sweden

[73] Assignee: Bejaco AB, Loddekopinge, Sweden

[21] Appl. No.: 799,172

[22] Filed: Nov. 18, 1985

[30] Foreign Application Priority Data

Nov. 26, 1984 [SE] Sweden ..... 8405943

[51] Int. Cl.[4] ..... B05B 7/06

[52] U.S. Cl. ..... 239/8; 239/290; 239/424

[58] Field of Search ..... 239/423, 424, 424.5, 239/290, 296, 565, 105, 419.3, 427.3, 8

[56] References Cited

U.S. PATENT DOCUMENTS

| | | | |
|---|---|---|---|
| 1,279,315 | 9/1918 | Foerst | 239/419.3 |
| 2,681,830 | 6/1954 | Peterman | 239/290 |
| 2,896,571 | 7/1959 | Geertsen | 239/105 X |
| 3,831,844 | 8/1974 | Tropeano et al. | 239/565 X |
| 3,848,807 | 11/1974 | Partida | 239/290 |

FOREIGN PATENT DOCUMENTS

| | | |
|---|---|---|
| 2427693 | 1/1975 | Fed. Rep. of Germany . |
| 2359647 | 12/1978 | France . |
| 2403831 | 4/1979 | France . |
| 8106637 | 11/1981 | Sweden . |

*Primary Examiner*—Andres Kashnikow
*Assistant Examiner*—Daniel R. Edelbrock
*Attorney, Agent, or Firm*—Laurence R. Brown

[57] ABSTRACT

Admixing of an atomized liquid to a gas flow (7 FIG. 1) may be performed without risk of recirculation and clogging caused thereby if the supply of atomized liquid according to the present invention is effected in separate part flows introduced into said gas flow (7) in such directions that each part flow has a component in the same direction as the direction of the gas flow (7). Each part flow is supplied at such location that it is wholly surrounded by a part of the gas flow (7). The invention also relates to a device for carrying out the above method, which device comprises a number of atomizing tubes for supply of the separate part flows of liquid and atomizing gas. The tubes have such axial and radial direction relative to the gas flow that the atomized liquid is directed into the gas flow to treat the gas flow in an area radially outside the tubes.

2 Claims, 4 Drawing Figures

METHOD OF MIXING AN ATOMIZED LIQUID INTO A GAS FLOW AND A DEVICE FOR CARRYING OUT SAID METHOD

This invention relates to a method of admixing an atomized liquid into a gas flow comprising contacting and dividing said liquid and atomizing gas into a number of part flows of atomized liquid and atomizing gas and introducing said part flows into said gas flow, each part flow having a component in the same direction as that of the gas flow.

A method of this type may be used e.g. when contacting an exhaust gas with lime water by atomizing a solution or a suspension of lime with compressed air or steam and mixing it with the exhasut gases for neutralising their contents of sulphur.

One problem involved in such method is that the solution or the suspension may easily be clogging to the injection device and this will be a hazard to the process. The reason for clogging is a combination of a high temperature and a recirculation of the gas flow to be treated.

The published Swedish patent application No. 8106637-5 shows a method according to which a plurality of flows of atomized liquid is delivered to a common flow of exhaust gas. The atomized liquid is delivered concurrent to the exhaust gas flow i.e. sheltered by the atomizing-injection device. Practical tests have shown that clogging rapidly occurs to such extent that the function of the device becomes poor.

It is also previously known that a main flow coud be mixed with additive flows as separate part flows. The French patent specification Nos. 2359647 and 2403831 show examples of this type, but they aim at turbulence by purpose.

The present invention has for its object to provide a method of the type referred to above in which the risk of clogging is minimised.

This is according to the present invention obtained thereby that the admixing of each separate part flow of atomized liquid and atomizing gas into the gas flow is performed so as to wholly surround each part flow of liquid and atomizing gas by parts of the gas flow in a plan perpendicular to the direction of the gas flow.

The invention also relates to a device for carrying out the method, said device comprising tubes for concurrent admixing of the liquid and atomizing gas into the gas flow, said device having a number of openings for introducing a mixture of liquid and atomizing gas to a duct for the gas flow to be treated.

According to the present invention said device is characterised in that each opening has such axial and radial position relative to the tubes that the openings terminate into the duct for the gas flow to be treated in an area having a larger dimension in the direction perpendicular to the direction of the gas flow to be treated than the dimension in the same direction for an area containing projections of the tubes.

Figure 1:
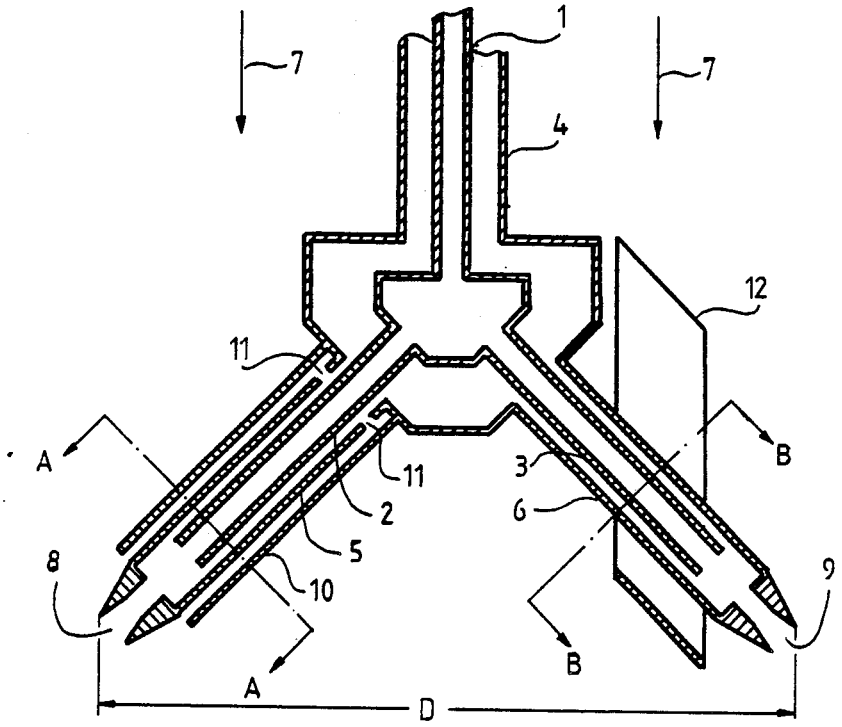
Figure 2:
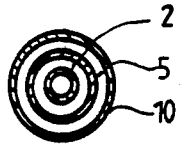
Figure 3:
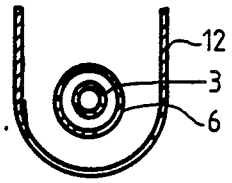
Figure 4:
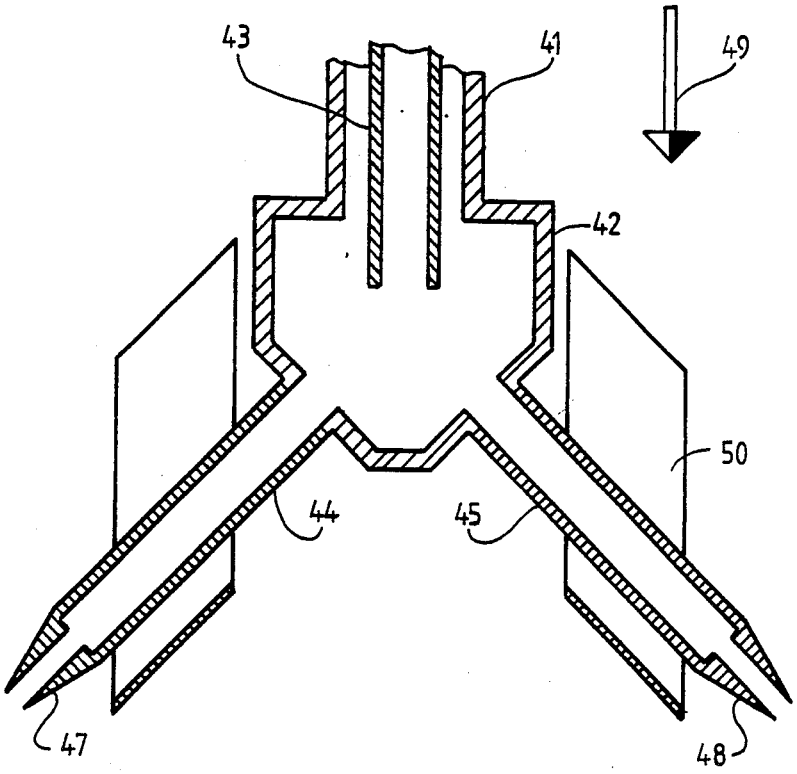

The invention will be described in more detail reference being made to the drawing in which FIG. 1 is an axial section of a device according to the invention, FIG. 2 is a section along the line A—A in FIG. 1, FIG. 3 is a section along the line B—B in FIG. 1 and FIG. 4 is an axial section of another embodiment of a device according to the invention.

In FIG. 1 the reference numeral 1 designates a conduit for supply of a slurry—e.g. a suspension of lime in water. The conduit 1 leads to a number of branch tubes 2,3 and is surrounded by a tube 4 also being divided into tubes 5,6. The tubes 4, 5, 6 contain an atomizing gas—e.g. compressed air or steam. The device is arranged in a duct for a flow of exhaust gas having a direction shown by arrows 7 in FIG. 1. The flows leaving the openings 8,9 of the tubes 5, 6 will become completely surrounded by the flow of exhaust gas. This is due to the fact that the openings 8, 9 are not shielded by the tubes 4, 5 and 6. The openings 8, 9 are located in an area in a plane perpendicular to the direction of the gas flow 7, said area having a greater diameter—D—than the dimension of the supply device 2, 5, 3, 6 in the same plane.

The flows leaving the openings 8 and 9 consist of an atomized lime suspension which will become mixed with the exhaust gases and react with them. In order to avoid turbulence, which could transport lime particles counter-current and cause deposits on the tubes 4, 5—especially near the openings 8 and 9—it is possible to surround the tube 5 by a coaxially mounted tube 10 being open only near the opening 8 of the tube 5. The tube 5 is, however, provided with a number of holes 11 at the end opposite to the opening 8. This possibility is shown in the left part of FIG. 1. Hereby a part of the atomizing gas will be fed into the holes 11. Any possible turbulence near the opening 8 will be eliminated by the flow of atomizing gas passing between the two tubes 5 and 10.

At the right hand side of the device shown in FIG. 1 it has been shown how it is possible to apply a guide vane 12 having U-shaped cross section in order to ensure a laminar flow of the exhaust gas near the opening 9.

FIG. 4 shows a device in which a supply duct 41 for atomizing gas terminates into a chamber 42 into which also a liquid supply duct 43 terminates. A mixture of atomized liquid and gas is withdrawn from the chamber 42 via a number of tubes 44 and 45 having nozzles 47 and 48 respectively. The nozzles 47 and 48 have such radial relative distance—in a plan perpendicular to the direction of a surrounding flow 49 of exhaust gas—that the flows of liquid and gas from each nozzle 47, 48 will be completely surrounded by a part of the flow 49. I.e. the nozzles 47, 48 will not be shielded by the parts 41–45 of the device.

The device according to FIG. 4 has also a guide vane 50—corresponding to the member 12 of FIGS. 1-3—in order to ensure the existence of a laminar flow 49 of the exhaust gases.

I claim:

1. A method of admixing an atomized liquid into a gas flow stream for treatment of the gas flow stream comprising the steps of, providing a plurality of part flows of an atomized liquid to be admixed with the gas flow stream, directing the part flows into the gas flow stream by means of tubes having outlets oriented in directions so that the part flows have flow components of atomized liquid directed in the same direction as the flow direction of the gas flow stream and flow components directed outwardly away from the tubes, surrounding the part flow of atomized liquid with flowing gas from the gas flow stream flowing in the gas flow stream direction as the atomized liquid passes through the outlets, thereby to treat the gas flow stream with the atomized liquid in an area outside the position of the tubes, whereby the life of the tubes without clogging is extended.

2. A device for admixing an atomized liquid into a gas flow stream for treatment of the gas flow stream, comprising in combination, a plurality of tubes extending into the gas flow stream and having openings for discharging a plurality of part flows of an atomized liquid into the gas flow stream, the tubes directed axially and radially relative to the direction of flow of the gas flow stream to direct the atomized liquid into the gas flow stream with an atomized gas flow component directed in the same direction as the flow direction of the gas flow stream for treatment of the gas in an area radially outside the position of the openings so that the gas flow stream is treated in an area having a larger dimension in the direction perpendicular to the direction of the gas flow to be treated than a dimension in the same direction for an area containing projection of the tubes, and flow guide means at least partially surrounding the tubes for directing gas flow along the tubes adjacent the tube openings to cause a laminar flow of gas around said tubes, wherein the flow guide means include atomizing gas transport tubes surrounding the tubes containing atomized liquid to provide a flow of atomizing gas to surround the flow of atomized liquid as it issues from the tube outlets to cause a laminar flow about the atomized liquid tubes to avoid recirculation of the gas flow stream adjacent the atomized liquid tube outlets.

* * * * *